US007604221B2

(12) United States Patent
Lass et al.

(10) Patent No.: US 7,604,221 B2
(45) Date of Patent: Oct. 20, 2009

(54) GUARDRAIL RUN

(75) Inventors: Horst Lass, Bochum (DE); Walter Klein, Katzwinkel (DE); Werner Heimann, Spiesen-Elversberg (DE)

(73) Assignee: Heintzmann Sicherheitssysteme GmbH & Co. KG, Bochum (DE)

( * ) Notice: Subject to any disclaimer, the term of this patent is extended or adjusted under 35 U.S.C. 154(b) by 0 days.

(21) Appl. No.: 12/063,918

(22) PCT Filed: Aug. 1, 2006

(86) PCT No.: PCT/DE2006/001336

§ 371 (c)(1),
(2), (4) Date: Feb. 15, 2008

(87) PCT Pub. No.: WO2007/022746

PCT Pub. Date: Mar. 1, 2007

(65) Prior Publication Data

US 2008/0230759 A1 Sep. 25, 2008

(30) Foreign Application Priority Data

Aug. 19, 2005 (DE) ..... 20 2005 013 218
Mar. 16, 2006 (DE) ..... 20 2006 004 364

(51) Int. Cl.
*A01K 3/00* (2006.01)

(52) U.S. Cl. ..... 256/13.1

(58) Field of Classification Search ..... 256/13.1; 404/6–9

See application file for complete search history.

(56) References Cited

FOREIGN PATENT DOCUMENTS

| | | | |
|---|---|---|---|
| DE | 20 2004 013 606 | | 10/2004 |
| EP | 743398 | A1 * | 11/1996 |
| FR | 2717196 | A1 * | 9/1995 |
| FR | 2718473 | A1 * | 10/1995 |
| FR | 2760028 | A1 * | 8/1998 |
| FR | 2793822 | A1 * | 11/2000 |
| FR | 2 811 344 | | 1/2002 |
| FR | 2833630 | A1 * | 6/2003 |
| FR | 2900941 | A1 * | 11/2007 |

* cited by examiner

*Primary Examiner*—Victor MacArthur
(74) *Attorney, Agent, or Firm*—Henry M. Feiereisen; Ursula B. Day

(57) ABSTRACT

A guardrail run with a rail is arranged along and substantially parallel to a roadway. The rail is made of consecutively arranged round timber sections with abutting end sections. Each round timber section includes a metal band disposed in a vertical groove extending along the bottom side. The timber sections are releasably attached to posts anchored alongside the roadway. A locking plate having a U-shape configuration with two legs connected by a web overlaps with the ends of the metal bands of two adjacent timber sections. The ends of the metal bands are received between the two legs of the locking plate, thereby coupling the metal bands with one another.

5 Claims, 4 Drawing Sheets

GUARDRAIL RUN

BACKGROUND OF THE INVENTION

The invention is directed to a guardrail run along a roadway.

Guardrail runs of this type are known in the art and are disclosed, for example, in FR 2 811 344. They have a rail made of round timber sections which extends essentially parallel to the roadway, with the rail supported via spacers on posts anchored in the ground. The end faces of two consecutive round timber sections abut one another. The round timber sections have on their bottom side a vertical groove in which a steel band is arranged. The steel band protrudes lengthwise over the ends of the round timber section. In the installed state, the steel bands therefore overlap in the grooves at the respective ends. Studs extend through the round timber sections and the steel bands and optionally also the spacers, which are thereby coupled to one another, with the coupled steel bands forming a tension chord.

The guardrail run in the aforedescribed embodiment is specifically designed for roadways in rural areas, in particular wooded areas, in order to visually blend with the environment.

The connections between two round timber sections is relatively unstable and can therefore only produce a small resistance for heavy vehicles, such as mid-sized and full-sized passenger cars and trucks. It should be noted that the round timber sections can inevitably only have a certain maximum diameter so as not to disturb the desired visual appearance.

The conventional guardrail run is also disadvantageous with respect to its installation. The steel bands must overlap in the grooves. To this end, the free ends of the steel bands must be threaded into the respective adjacent end of a round timber section, which has proven to be extremely difficult in practical applications. In addition, the studs must be inserted through the round timber sections and the overlapping ends of the steel bands, before they can be attached to the spacers.

An attempt to remedy these disadvantages has been proposed in the prior filed utility model DE 20 2005 013 218 U1, which shows a guardrail run with metal bands that are coupled by locking plates. The locking plates are provided in the form of flat metal plates which contact one side of the metal bands. The locking plates can be easily inserted through slots provided in the round timber sections.

SUMMARY OF THE INVENTION

Based on the state of the art, it is an object of the invention to improve a guardrail run of the aforedescribed type so that the guardrail provides increased resistance to impacting objects.

This object is attained by a guardrail run along a roadway, including a rail which extends substantially parallel to the roadway and is made of round timber sections having abutting ends, wherein the round timber sections are releasably attached to posts which are anchored alongside the roadway, wherein each round timber section has on its bottom side a vertical groove in which a metal band is arranged, wherein the metal bands consecutively arranged in the rail are coupled to one another by locking plates, wherein the locking plates have a U-shape configuration with two legs connected to one another by a web, wherein the locking plates overlap with the ends of two adjacent metal bands, and wherein the ends are received between the legs.

The core idea of the invention is that the locking plates are U-shaped in the form of two legs connected by a web, and that the locking plates overlap with the ends of two adjacent metal bands, wherein the ends are received between the legs.

With this design, the metal bands are coupled together by the locking plates, thereby forming a continuous tension chord in the rail. In the event of an impact by a truck, the guard rail run can withstand very high tension loads due to the shape of the locking plates, whereby the tension chord ensures the protective function of the guardrail run, even if individual posts break off, for example, as a result of a direct impact.

With the design of the locking plate according to the invention, which overlaps with the metal bands, the guardrail run is securely stabilized at the coupling locations. This counters the introduction of damaging torques in the round timber sections, formation of kinks at the coupling location or splicing of the round timber sections. Due to the high dimensional stability, the tensile strength of the tension chord is substantially greater than with conventional embodiments. Advantageously, the locking plates are configured symmetric.

According to an advantageous embodiment, the web has a slot extending in a longitudinal direction of the web. The locking plates are fabricated from a single metal plate by stamping and bending. Incorporation of the slot facilitates bending of the locking plate.

Advantageously, the web may be disposed along upper longitudinal edges of the legs. The locking plate can then pushed during installation of the guardrail run onto the ends of the metal bands from above and thereafter secured to the post together with the metal bands. To this end, the round timber sections have at their ends insertion slots which extend parallel to the groove, with the locking plates inserted into the insertion slots. The locking plates can be inserted through the insertion slots, after the round timber sections have been loosely attached to the posts.

Advantageously, the ends of the round timber sections may be attached to the posts with interposed spacers. The spacers operate here as a buffer between the round timber sections and the posts, so that the posts are not damaged in an accident causing only a minor impact. In addition, the posts can be also be anchored along the side of the roadway.

The locking plates, the metal bands, the round timber sections, and the spacers have aligned bores and are connected with one another by studs extending through the bores. During installation, one end of a round timber section together with a locking plate can initially be loosely attached to a spacer with a stud. In the next step, a second round timber section is then positioned and the locking plate is inserted into the adjacent slot. When the bores in the second round timber section and in the spacer are aligned, a stud can be inserted for establishing a secure connection. In a final step, the stud at the first round timber section is tightened.

The bores in the locking plates and/or spacers may be implemented as slots oriented in the longitudinal direction of the rail. The slots facilitate installation because they allow for compensation in the length. The slots can also support yielding of a guardrail run, because in a crash, the play in the connection can advantageously be utilized, before the entire load effects the connection region. The capability of compensating for length variations provides also advantages under stationery conditions, because the materials of the employed components have different thermal expansion coefficients. Possible harmful tension forces can thereby be countered.

In a particularly advantageous embodiment, the locking plates can be placed transversely on the studs via slots disposed on the outer bores. With this feature, the round timber sections can initially be loosely attached to the spacers by way of the outer bores; the locking plates to be coupled are then inserted from above through the slots, whereafter the inner studs are inserted. All studs are then tightened so as to establish a secure connection. Accordingly, this embodiment significantly simplifies the installation.

BRIEF DESCRIPTION OF THE DRAWING

Exemplary embodiments of the invention will now be described with reference to the drawings. It is shown in.

In all the figures, identical elements of the guardrail run have identical reference symbols.

DETAILED DESCRIPTION OF PREFERRED EMBODIMENTS

Figure 1:
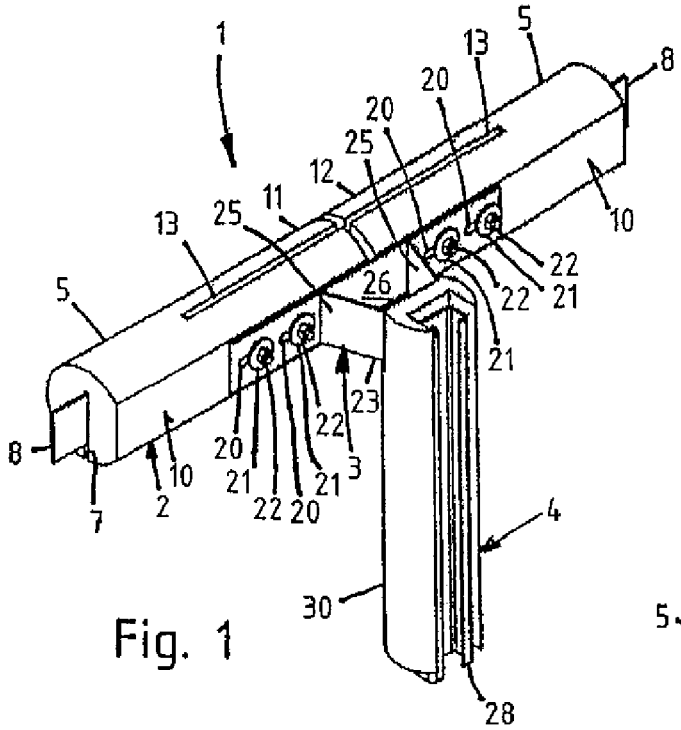
FIG. 1 a section of a guardrail run in a perspective view from the backside.
Figure 2:
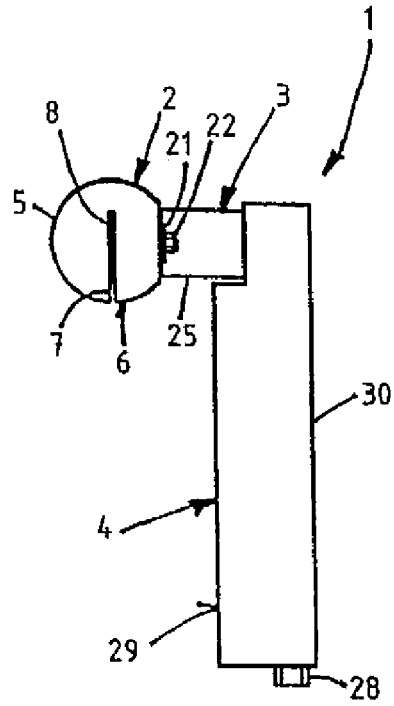
FIG. 2 a side view of the guardrail run.

FIGS. 1 to 5 show sections of the guard rail run 1 of the invention in several different views. Such guardrail runs 1 are typically arranged along roadways. They have a rail 2 which is attached to posts 4 with interposed spacers 3.

The rail 2 extends essentially parallel to the roadway, with the sections of the rail 2 composed of round timber sections 5 which abut in the region of the posts 4. Each round timber section 5 has on its bottom side 6 a vertical groove 7. A metal band 8 is arranged in the groove 7, with the band 8 extending between the end faces 9 of the round timber section 5. The metal band 8 is made of steel and has typically a thickness of 5 mm. The circumference of the round timber sections 5 facing the posts is flattened. In these flat regions 10, a corresponding spacer 3 is interposed in the connecting region between two raw timber sections 5 and a post 4.

The ends 11, 12 of the round timber sections 5 have insertion slots 13 which extend parallel to the groove 7 and are adapted for insertion of a locking plate 14. The locking plate 14 establishes the connection between the metal bands 8 of adjacent round timber sections 5, thereby forming a continuous tension chord in the guardrail run 1. At each end 11, 12 of the round timber sections 5, in the region of the insertion slot 13, two studs 15, 16 connect the round timber section 5, the metal plate 8, the locking plate 14 and the spacer 3. The aforedescribed components 5, 8, 14, 3 have aligned bores 17 to 20 (see FIGS. 9 and 10) to facilitate insertion of the studs 15, 16.

The studs 15, 16 are arranged at the same height and in parallel, with a horizontal spacing therebetween. On the side facing the post, the studs 15, 16 are tightened with nuts 22 and interposed washers 21. When installed, the locking plate 14 overlaps with the ends 43, 44 (see FIG. 3) of two adjacent metal bands 8. The locking plate 14 of the invention will now be described in more detail with reference to FIGS. 5 to 10.

The spacer 3 has a C-shaped center section 23, which is essentially trapezoidal when viewed from the top. The center section 23 consists of a web 24, from which two legs 25 extend in a wing-like configuration. The legs 25 are bent outwardly in the longitudinal direction of the rail 2. The legs 25 are also connected with one another by an edge plate 26. The edge plate 26 is welded to the legs 25 and is flush at its lateral edges with the lateral edges of the bent sections of the legs 25. Two bores in the form of slots 20 are provided on each leg 25 and in the edge plate 26 at those locations where the spacer is penetrated by the studs 15, 16 of the rail 2. An additional slot 27 in the web 24 is provided for releasable attachment of the spacer 2 to the post 4.

The post 4 has an inner profile 28 made of steel with a C-shaped cross-section and is secured in the ground. The inner profile 28 is covered with a wooden cover 30 on the side 29 facing the roadway and on the sides pointing in the longitudinal direction of the rail 2. The top end 31 of the wooden cover 30 has an oblong opening. In this region, the web 24 of the spacer is attached with a screw. A stud 32 extends through the spacer 3, the wooden cover 30 and the inner profile 28.

Figure 6:
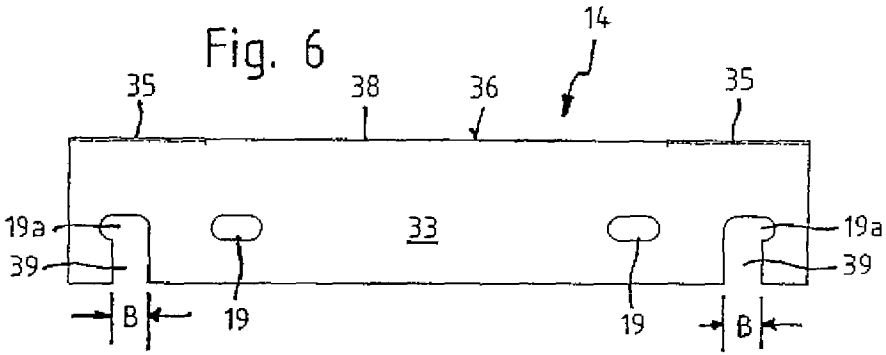
FIGS. 6-8 the locking plate in three different side views.
Figure 8:
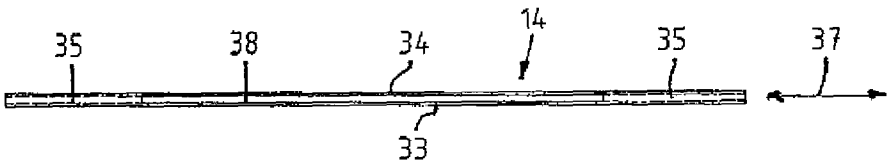
Figure 7:
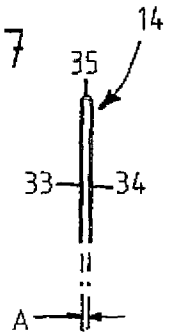
Figure 5:
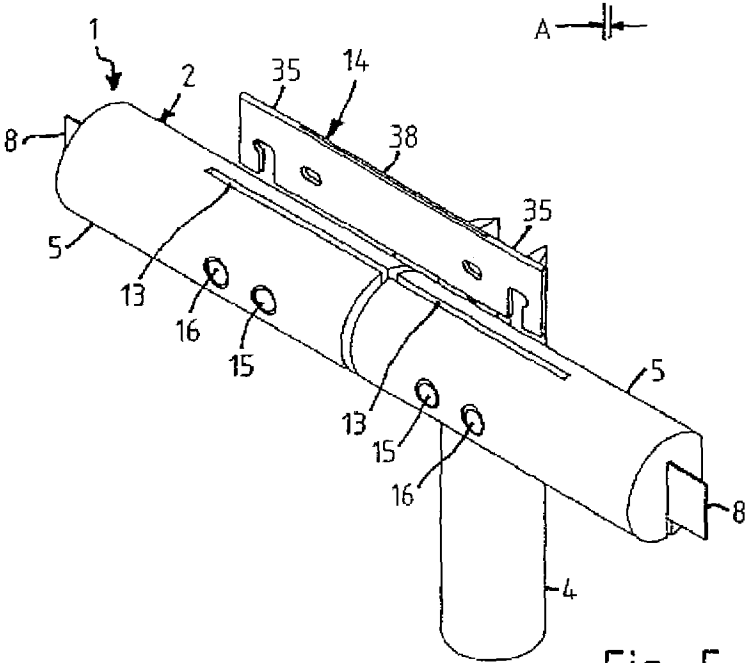
FIG. 5 the guardrail run of FIG. 4, showing the locking plate above the rail.

FIG. 5 shows the locking plate 14 above the insertion slots 13 of the guardrail run 1. Additional side views of the locking plate 14 are shown in FIGS. 6 to 8. The locking plate 14 is U-shaped and produced from a metal plate by stamping and bending. It has two legs 33, 34 which are connected with one another by a web 35. The web 35 is disposed along with the upper longitudinal edges 36 of the legs 33, 34 and has a slot 38 extending in the longitudinal direction 37 of the web. The legs 33, 34 are spaced apart by a distance A which is greater than the thickness of the metal bands 8 received between the legs 33, 34 in the installed state. The locking plate 14 which is made of steel can be inserted in the insertion slots on-edge 13. Two respective bores 19, 19*a* in the form of slots and oriented in the direction of the rail 2 are disposed on either end of the locking plate 14. The outer slots 19*a* have transverse slots 39 of a width B which is dimensioned so that the locking plate 14 can be placed onto the outer studs 16.

Figure 3:
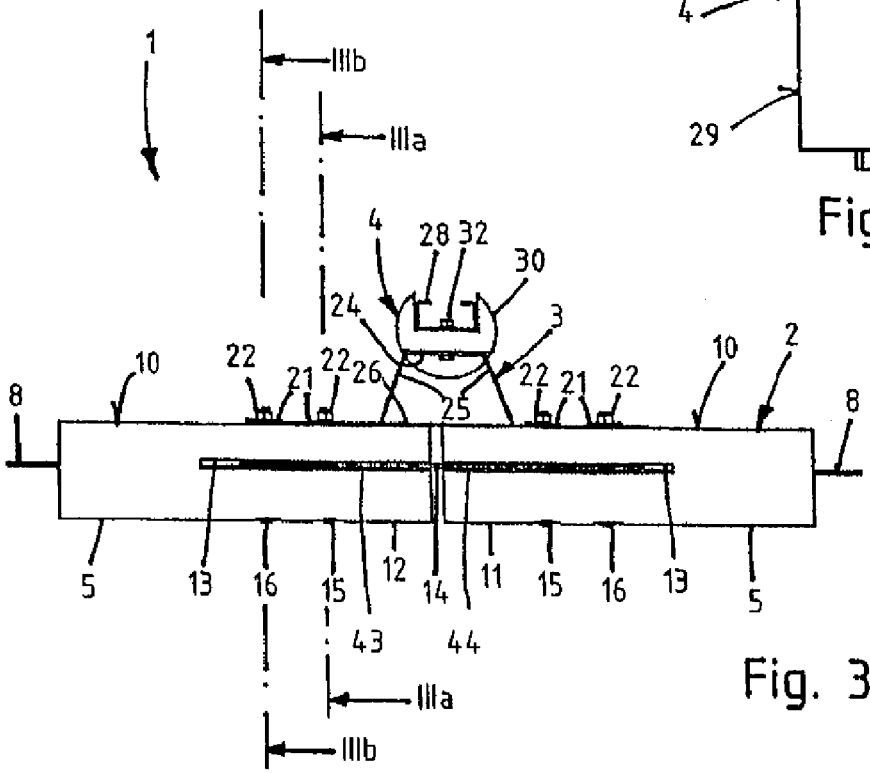
FIG. 3 a top view of the guardrail run.
Figure 4:
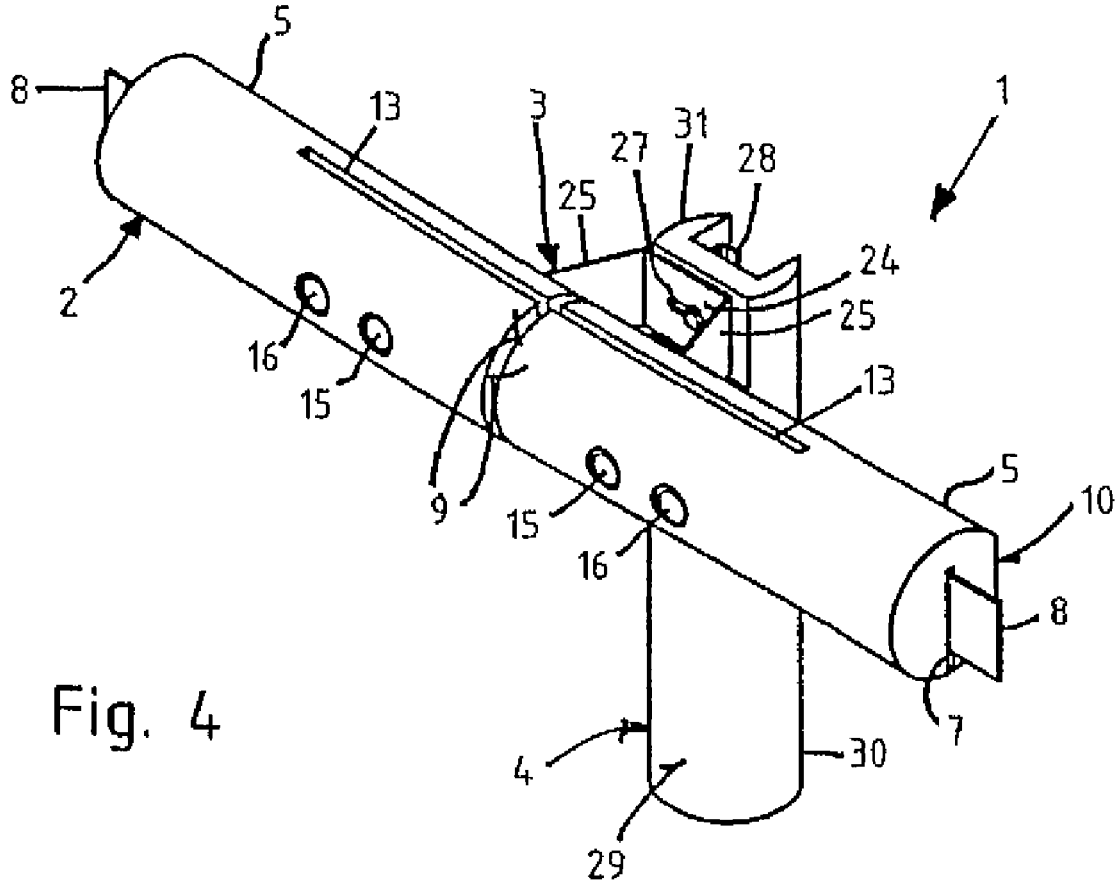
FIG. 4 a section of the guardrail run in a perspective view from the front.
Figure 9:
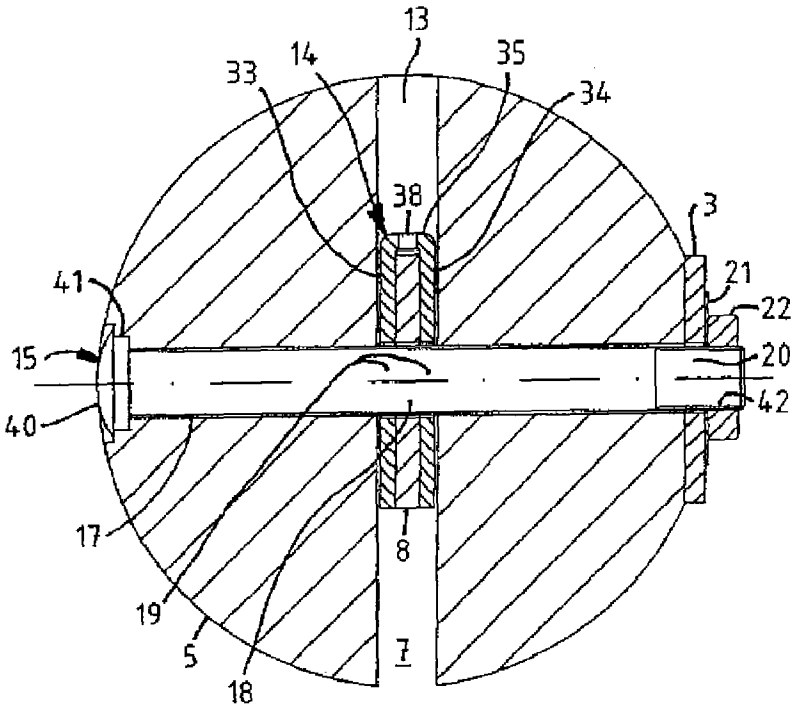
FIG. 9 the rail in a cross-sectional view taken along the line IIIb of FIG. 3.

FIG. 9 shows a cross-section through the round timber section along the line IIIa of FIG. 3. The cross-section of FIG. 10 extends along the line IIIb of FIG. 3. The studs 15, 16 are illustrated as carriage bolts with a square neck and extend through bores 17 to 20 in the round timber section 5, in the metal band 8, in the locking plate 14, and in the spacer 3. The heads 40 of the studs 15, 16 are arranged on the side of the guardrail run 1 facing the roadway in recessed bores 41. The studs 15, 16 have a thread 42 facing the post on which the nuts 22 are screwed with interposed washers 21.

Figure 10:
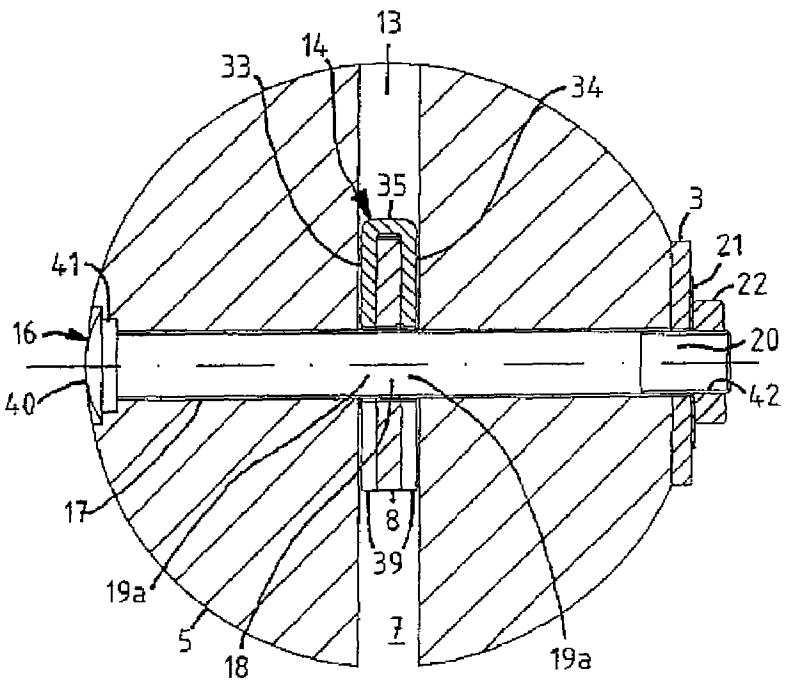
FIG. 10 the rail in a cross-sectional view taken along the line IIIa of FIG. 3.

The groove 7 and the insertion slot 13 are arranged in the center without a spacing therebetween. The locking plate is pushed from above through the insertion slot 13 onto the metal band 8. The ends of the metal bands 18 are hereby received between the legs 33, 34. As seen in FIG. 9, the web 35 between the legs 33, 34 has a slot 38. As shown in FIG. 10, a transverse slot 39 is provided in the locking plate 14 below the studs 16, which makes installation much easier.

The guardrail run 1 of the invention is able to particularly withstand high tensile loads and can be easily installed. By coupling the metal bands 8 by way of the locking plates 14 and the spacers 3, the guardrail run 1 of the invention provides the same protection as steel guardrails.

During installation, the posts 4 are first anchored in the ground. The spacers 3 are then installed on the posts 4. The round timber sections 2 together with the metal bands 8 arranged therein are delivered to the construction site ready for installation. The round timber sections 5 are then loosely attached on the outer slots 20 of the spacers 3 with the outer studs 16. A locking plate 14 is then inserted from above into the insertion slot 13, and the locking plate 14 can drop or can be pushed onto the outer stud. Finally, the inner studs 15 are inserted, and all the studs 15, 16 are tightened.

What is claimed is:

1. A guardrail run arranged along a roadway, the guardrail run comprising:

a rail which extends substantially parallel to the roadway and is made of consecutively arranged round timber sections having confronting ends, each of the round timber sections having a bottom side and a vertical groove disposed on the bottom side;

a metal band disposed in each vertical groove;

a post anchored alongside the roadway for releasable attachment of the round timber sections;

a locking plate having a U-shape configuration with two legs connected by a web, with the locking plate overlapping with confronting ends of the metal bands of two adjacent of the consecutively arranged timber sections and receiving the confronting ends of the metal bands between the two legs for coupling the metal bands with one another;

a spacer interposed between the confronting ends of the round timber sections and the post;

studs extending through aligned bores disposed in the locking plate, the metal bands, the round timber sections and the spacer, and connecting the locking plate, the metal bands, the round timber sections and the spacer with one another; and wherein outer bores of the locking plate include transverse slots open to an edge of the locking plate, allowing the locking plate to be placed transversely over the studs.

2. The guardrail run of claim 1, wherein the web comprises a slot extending in a longitudinal direction of the web.

3. The guardrail run of claim 1, wherein the web is disposed along upper longitudinal edges of the two legs.

4. The guardrail run of claim 1, wherein the round timber sections have at their respective ends insertion slots extending parallel to the groove, with the locking plate inserted into the insertion slots.

5. The guardrail run of claim 1, wherein the bores in the locking plate or spacer, or both, are implemented as slots oriented in a longitudinal direction of the rail.

* * * * *